US005641250A

United States Patent [19]

Bostelmann et al.

[11] Patent Number: 5,641,250

[45] Date of Patent: Jun. 24, 1997

[54] METHOD AND APPARATUS FOR TRANSPORTING FILTER ROD SECTIONS

[75] Inventors: Rudolf Bostelmann, Geesthacht; Birger Buhk, Hamburg; Jan Burmester-Perrei, Hamburg; Hans-Herbert Schmidt, Hamburg; Rolf Petersen, Gülzow, all of Germany

[73] Assignee: Hauni Maschinenbau AG, Hamburg, Germany

[21] Appl. No.: 397,349

[22] Filed: Mar. 2, 1995

[30] Foreign Application Priority Data

Mar. 14, 1994 [DE] Germany ..... 44 08 494.3

[51] Int. Cl.[6] ..... B65G 51/02

[52] U.S. Cl. ..... 406/11; 406/13; 406/19; 406/31; 406/68; 131/282; 198/572

[58] Field of Search ..... 406/10, 11, 12, 406/13, 19, 29, 31, 62, 63, 64, 65, 67, 68; 198/571, 572, 577; 131/88, 95, 282, 283

[56] References Cited

U.S. PATENT DOCUMENTS 3,365,239 1/1968 Molins et al. ..... 406/62
3,827,757 8/1974 Heitmann et al. ..... 406/67

FOREIGN PATENT DOCUMENTS 2068325 8/1981 United Kingdom .
2070545 9/1981 United Kingdom .

*Primary Examiner*—Andrew C. Pike
*Attorney, Agent, or Firm*—Darby & Darby

[57] ABSTRACT

Filter rod sections are transported sideways from a magazine containing a pile of parallel sections toward positions of alignment with the inlet of a pneumatic conveyor and are propelled into the conveyor at a transfer station where they continue to move sideways. In order to avoid damage to sections during propulsion into the conveyor, the duration of complete transfer of successive sections into the inlet is monitored in order to generate signals denoting the intervals of axial advancement of successive sections all the way into the conveyor. Such signals are compared with signals denoting those intervals of sidewise movement of sections past the transfer station during which the sections can move axially without being damaged by the stationary inlet of the conveyor. The evaluating circuit which compares the signals generates defect signals when the transfer of sections in unsatisfactory, and such defect signals are used to reestablish the possibility to advance undamaged sections into the conveyor or to expel the fragments of destroyed or partially destroyed sections from the conveyor and/or from those parts of the apparatus which supply articles to the transfer station.

28 Claims, 4 Drawing Sheets

METHOD AND APPARATUS FOR TRANSPORTING FILTER ROD SECTIONS

The invention relates to improvements in methods of and in apparatus for manipulating rod-shaped articles of the tobacco processing industry, especially filter rod sections of the type customarily employed for the making of filter cigarettes, cigars, cigarillos, and/or other tobacco-containing products. More particularly, the invention relates to improvements in methods of an in apparatus for converting a supply of at least partially overlapping parallel rod-shaped articles of the tobacco processing industry (hereinafter called articles for short), e.g., a continuously replenished pile of parallel articles in a magazine, into a file of axially aligned articles which are being propelled or which are ready to be propelled into the magazine of a processing or consuming machine (such as a filter tipping machine).

It is customary to employ a so-called sender which receives filter rod sections from a maker or from a magazine (e.g., a tray or a reservoir) and serves to pneumatically propel filter rod sections to the magazine of a processing or consuming machine. A typical example of such processing or consuming machine is a filter tipping machine wherein filter rod sections of unit length or multiple unit length are assembled end-to-end with plain cigarettes of unit length or multiple unit length into filter cigarettes of unit length or multiple unit length. Apparatus of such type are known as FILTROMATS and are distributed by the assignee hereof. A FILTROMAT known as S2 is normally furnished with between two and ten sender stations for transport of discrete files of axially aligned filter rod sections between one or more sources and one or more processing or consuming machines. Each sender station delivers a file of aligned filter rod sections into a discrete pneumatic conveyor wherein the sections are propelled end-to-end or at intervals on their way into a suitable magazine.

Presently known sender stations accommodate rotary conveyors which are provided with axially parallel peripheral receptacles for discrete rod-shaped articles and wherein the articles are transported sideways (at right angles to their respective axes and at right angles to the axis of rotation of the respective conveyor) to a transfer station where the articles in successive receptacles are propelled axially into a pneumatic conveyor for longitudinal movement toward and into a magazine. The means for propelling includes means for discharging blasts of compressed air which are caused to flow into the receptacles arriving at the transfer station to effect the expulsion of the article from such receptacle into a single pneumatic conveyor or into the respective pneumatic conveyor.

Problems are likely to develop at the transfer station when the transfer of articles from the receptacles of the rotary conveyor into the inlet of a pneumatic conveyor takes place at a high or extremely high frequency because the conveyor continues to orbit its receptacles along an endless circular or other path not only during advancement of an article toward the transfer station but also during expulsion or propulsion of such article from the respective receptacle at the transfer station. In other words, an article which is in the process of being expelled from its receptacle continues to move along the endless path about the axis of the rotary conveyor and is simultaneously compelled to perform an axial movement relative to the receptacle and into the inlet of the adjacent pneumatic conveyor.

Attempts to reduce the likelihood of jamming and the resultant deformation or total destruction of articles at the transfer station involve appropriate changes in the configuration of the receptacles and/or of the inlet of the pneumatic conveyor. The width of the outlet of each receptacle and/or of the inlet of the pneumatic conveyor is increased in the direction of the endless path for the receptacles in order to lengthen the intervals which are available for propulsion of articles from their receptacles into the inlet of the pneumatic conveyor. The speed of movement of receptacles along their endless path as well as the speed of axial movement of articles into the pneumatic conveyor must be selected by full consideration of the shape of the outlet of each receptacle and/or the shape of the inlet of the pneumatic conveyor. As a rule, the inlet of the pneumatic conveyor resembles a funnel having a substantially conical or similar surface the cross-sectional area of which decreases in a direction away from the transfer station.

When the aforedescribed apparatus operate in a satisfactory manner, an article at the transfer station must be completely expelled from its receptacle before the latter begins to advance beyond the transfer station; this ensures that the next-following (article-containing) receptacle can enter the transfer station to move its article to a position of adequate alignment with the inlet of the pneumatic conveyor, i.e., to a position in which the article can begin its axial movement out of the respective receptacle and into the pneumatic conveyor. Damage to an article takes place if the trailing end of the article is still confined in the adjacent end portion of its receptacle when such end portion of the receptacle is no longer aligned with the inlet of the pneumatic conveyor. The article which is still in the process of leaving its receptacle is then deformed (or crushed in its entirety) by the surface or surfaces bounding the stationary inlet of the pneumatic conveyor. As already mentioned above, the conveyor is or can be driven at a very high speed (in order to increase the output of the apparatus) so that the surface or surfaces bounding that end of a receptacle which is nearest to the transfer station exert a highly pronounced shearing and/or other severing or destroying action which is amply sufficient to destroy a standard filter rod section. If a filter rod section is sheared all the way across during unsuccessful expulsion from its receptacle while the latter is caused to move past the transfer station, a portion of the thus severed filter rod section remains in the receptacle so that the latter cannot receive (or cannot properly receive) a fresh filter rod section during renewed movement of the partially emptied receptacle past the source of rod-shaped articles.

The removal of a fragmentized filter rod section from its receptacle necessitates a complete shutdown of the apparatus with attendant substantial losses in output. The reason is that heretofore known apparatus are not constructed and/or assembled in such a way that a portion of a severed filter rod section (or the remnants of a crushed filter rod section) could be removed from the respective receptacle while the conveyor which transports or embodies the receptacle is still in motion.

OBJECTS OF THE INVENTION

An object of the invention is to provide a simple but reliable method of converting a supply of parallel and at least partially overlapping rod-shaped articles of the tobacco processing industry into a file of axially aligned articles without risking damage to (or with lesser risk of damage to) the articles during a change of the direction of movement from transversely of the axes of the moving articles to axial movement, e.g., toward the magazine of a processing or consuming machine.

Another object of the invention is to provide a method which renders it possible to greatly reduce the down times of apparatus for the conversion of supplies of at least partially overlapping parallel articles into a file of axially aligned articles.

A further object of the invention is to provide a method which renders it possible to reduce the likelihood of shearing of readily or reasonably readily deformable and/or severable rod-shaped articles at the transfer station between a rotary conveyor which moves the articles sideways and a pneumatic conveyor which receives articles from the rotary conveyor and serves to advance the articles axially in the form of a file.

An additional object of the invention is to provide a method which renders it possible to periodically clean (or to clean when necessary) the receptacles of a rotary conveyor which delivers articles to a transfer station for propulsion into the inlet of a pneumatic conveyor serving to form and to advance a file of axially aligned articles.

Still another object of the invention is to provide a novel and improved method of regulating or controlling the operation of an apparatus for the conversion of a supply of at least partially overlapping parallel rod-shaped articles into a file of axially aligned articles.

A further object of the invention is to provide an apparatus which can be utilized for the practice of the above outlined method and the output of which can exceed, or greatly exceed, the output of heretofore known apparatus without risking damage to a higher percentage of manipulated articles.

Another object of the invention is to provide novel and improved means for controlling the operation of the conveyors in the above outlined apparatus.

An additional object of the invention is to provide the apparatus with novel and improved means for ensuring rapid, complete, and predictable expulsion of rod-shaped articles from the receptacles of the rotary conveyor at the transfer station between such receptacles and the inlet of a pneumatic conveyor.

Still another object of the invention is to provide the above outlined apparatus with novel and improved means for cleaning the receptacles, either periodically or when necessary to expel portions of rod-shaped articles which failed to enter the pneumatic conveyor.

A further object of the invention is to provide the apparatus with novel and improved means for reducing the likelihood of damage to rod-shaped articles at the transfer station even if the inlet of the pneumatic conveyor and/or the receptacles of the rotary conveyor are not specifically designed to prolong the interval of adequate alignment of a receptacle at the transfer station with the inlet of the pneumatic conveyor.

Another object of the invention is to provide the apparatus with monitoring, sensing, detecting, and like devices which are distributed and cooperate in a novel way to either eliminate the likelihood, or at least greatly reduce the frequency, of damage to or destruction of filter rod sections during transfer from discrete receptacles into a pneumatic conveyor which is designed to advance a file of axially aligned filter rod sections.

An additional object of the invention is to provide the apparatus with novel and improved means for accurately synchronizing the movements of the rotary conveyor with the intensity of propulsion of rod-shaped articles from the receptacles of the rotary conveyor into the pneumatic conveyor.

Still another object of the invention is to provide an apparatus which can be readily converted for the manipulation of smaller-diameter or larger-diameter rod-shaped articles.

A further object of the invention is to provide an apparatus wherein one or more constituents of the means for propelling articles from the receptacles of the rotary conveyor into the pneumatic conveyor can be utilized for the cleaning of the pneumatic conveyor and/or for the cleaning of the rotary conveyor.

SUMMARY OF THE INVENTION

One feature of the present invention resides in the provision of a method of converting a supply of at least partially overlapping parallel rod-shaped articles of the tobacco processing industry (such as filter rod sections which are to be delivered to a filter tipping machine for the making of filter cigarettes, cigars, cigarillos, or other tobacco-containing products) into a file of axially aligned articles. The method comprises the steps of moving a series of successive articles from the supply along a first path in a first direction substantially at right angles to the axes of the articles into and along a predetermined section of the first path, advancing successive articles of the series axially in a second direction from the section of the first path into a second path wherein the advancing articles form a file of axially aligned articles (this advancing step includes propelling the articles axially during movement in the first direction along the section of the first path), monitoring the extent of axial advancement of successive articles along the section of the first path during movement of the respective articles along such section, and generating defect signals in response to detection of incomplete advancement of articles into the second path during movement along the section of the first path.

The signal generating step can include generating a defect signal when at least a portion of an article is still disposed within the first path upon completion of movement along the section of the first path.

The first path can constitute or resemble an arcuate path (e.g., an endless circular path) for orbital movement of articles in the first direction about a fixed axis which is at least substantially parallel to the axes of the articles in the supply.

The method further comprises the step of tracking the length of intervals between entry and departure of receptacles for transport of articles along the first path into and from the aforementioned section of the first path. Such receptacles can constitute an array or set of parallel receptacles forming part of a conveyor in which a first end of each transported article is evacuated from its receptacle ahead of the second end of the respective article (as seen in the second direction). The tracking step can include tracking a first instant of .entry of each receptacle into the section of the first path and a second instant of departure of the receptacle from such section. The signal generating step then preferably includes ascertaining the length of intervals which elapse between the first and second instants for each receptacle moving along the section of the first path and generating a defect signal when a portion of the article remains in its receptacle upon expiration of the interval.

The method can further comprise the step of interrupting the movement of articles in the first direction in response to the generation of defect signals.

The moving step can include transporting the articles in exposable parallel receptacles of the aforementioned conveyor, and the method can further comprise the step of exposing selected receptacles to facilitate the removal of articles from the exposed receptacles in response to the generation of defect signals.

The advancing step preferably comprises propelling the articles with streams of a compressed gaseous fluid, and the method can further comprise the step of expelling articles from the section of the first path with compressed gaseous fluid in a direction other than the second direction (particularly in a direction counter to the second direction) in response to the generation of defect signals.

Another feature of the present invention resides in the provision of an apparatus for converting a supply (such as a pile) of at least partially overlapping rod-shaped articles of the tobacco processing industry into a file of axially aligned articles, particularly filter rod sections which are to be delivered into the magazine of a filter tipping machine for the making of filter cigarettes, cigars, cigarillos, or other tobacco-containing products. The improved apparatus comprises means for moving a series of successive rod-shaped articles from the supply along a first path in a first direction substantially at right angles to the axes of the articles into and along a predetermined section of the first path, means for advancing successive articles of the series along an elongated second path wherein the articles advance axially and form the file of axially aligned articles (such second path has an inlet at the section of the first path and the means for advancing includes means for propelling successive articles of the series from the section of the first path in a second direction and along the second path), means for monitoring the extent of axial movement of successive articles of the series in the second direction, and means for generating defect signals in response to detected lack or absence of completion of advancement of articles from the first path within predetermined intervals of time.

The advancing means comprises or can comprise a pneumatic conveyor, and the means for propelling can comprise means for directing streams of compressed air or another suitable compressed gaseous fluid against successive articles in the section of the first path.

The means for moving the articles along the first path can comprise a rotary conveyor (e.g., a drum or cylinder which is rotatable about a horizontal axis) having a plurality of elongated receptacles for discrete articles and means for driving the rotary conveyor to orbit the receptacles about an axis which is at least substantially parallel to the axes of the articles in the supply.

The article moving means and the article advancing means define a transfer station which is disposed at the section of the first path, and the monitoring means is or can be located at the transfer station.

The apparatus can further comprise means for sealing the receptacles at the transfer station. The monitoring means can be at least partially confined in the sealing means. The sealing means can include a mobile sealing device (e.g., a block or a shoe) having at least one first sealing surface, and the moving means of such apparatus can comprise at least one second sealing surface for each receptacle. The second sealing surfaces cooperate with the at least one first sealing surface to seal the transfer station and the inlet of the second path during movement of the respective receptacles past the transfer station.

The aforementioned rotary conveyor can be provided with a peripheral surface (such as a cylindrical peripheral surface) having recesses parallel to the axis of rotation of the conveyor and forming part of the receptacles for discrete articles. The second sealing surfaces of the sealing means are adjacent those portions of the peripheral surface of the rotary conveyor which are adjacent the recesses, and the monitoring means can include at least one sensor which is at least partially confined in the sealing means and is disposed at the transfer station.

As mentioned above, the moving means can comprise a series of successive receptacles for discrete articles and means for transporting the receptacles along the first path. Such apparatus preferably further comprises means for tracking the positions of successive receptacles during transport along the section of the first path and for generating additional signal denoting the positions of the receptacles during transport past the section of the first path. The means for generating defect signals then includes means for evaluating the additional signals and for generating third signals denoting the lengths of intervals elapsing during transport of successive receptacles along the section of the first path. Such intervals constitute the aforementioned predetermined intervals.

The evaluating means can further comprise means for ascertaining the presence and absence of full overlap between the signals which are generated by the monitoring means and denote the extent of axial displacement of an article and the respective third signals, and for generating defect signals in response to ascertained absence of full overlap between the signals which are generated by the monitoring means and the corresponding signals generated by the tracking means. The tracking means can comprise first and second detectors which are disposed at the transfer station and are spaced apart from each other in the first direction to respectively generate first and second additional signals denoting the arrival of a receptacle at the section of the first path and the departure of such receptacle from the section of the first path.

The first detector can be installed at the transfer station at least substantially in line with the upstream end of the section of the first path (as seen in the first direction), and the second detector is or can be located at the transfer station downstream of and spaced apart from the section of the first path by a distance which at least approximates the diameter of an article.

The transporting means can comprise a prime mover which is operatively connected with the evaluating means to interrupt the movement of the receptacles in the first direction in response to the generation of each defect signal. The prime mover can constitute a reversible prime mover (such as a reversible electric motor) which serves to normally transport the receptacles in the first direction along the first path and is operatively connected with the evaluating means to move the receptacles (preferably through a predetermined distance) counter to the first direction in response to the generation of defect signals.

The aforementioned shoe, block, or an analogous mobile device of the novel and improved sealing means can be displaced by means for moving such device between a sealing position at the transfer station and a second position in which the receptacle at the transfer station is accessible. The means for displacing the mobile device of the sealing means is or can be operatively connected with (i.e., controlled by) the evaluating means to move the mobile sealing device from the sealing position (and to thus render accessible that receptacle which is located at the transfer station) to the second position in response to the generation of defect signals.

The apparatus can also comprise means for expelling the contents (if any) of the receptacles at the transfer station in response to the generation of defect signals. The expelling means can include or can form part of the aforementioned propelling means.

The advancing means can comprise a pneumatic conveyor having an inlet at the section of the first path (i.e., at the transfer station), and the expelling means can include a source of compressed air or another suitable compressed gaseous fluid and means for communicatively connecting the source of compressed fluid with the pneumatic conveyor downstream of the inlet of the pneumatic conveyor (as seen in the second direction) in response to the generation of defect signals to thus admit compressed gaseous fluid into the receptacle at the transfer station by way of the inlet of the pneumatic conveyor.

The means for displacing the aforementioned mobile device of the sealing means can be operatively connected with the evaluating means to move the sealing device from the sealing position to the second position in response to the generation of defect signals. Such apparatus can further comprise means for cleaning the sealing device in the second position including a source of compressed gaseous fluid and valve-controlled means for directing compressed fluid from such source against at least one selected portion of the sealing device in response to the generation of defect signals. The at least one selected portion of the sealing device can be provided with a surface which confronts the moving means, and the valve-controlled means can include one or more nozzles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
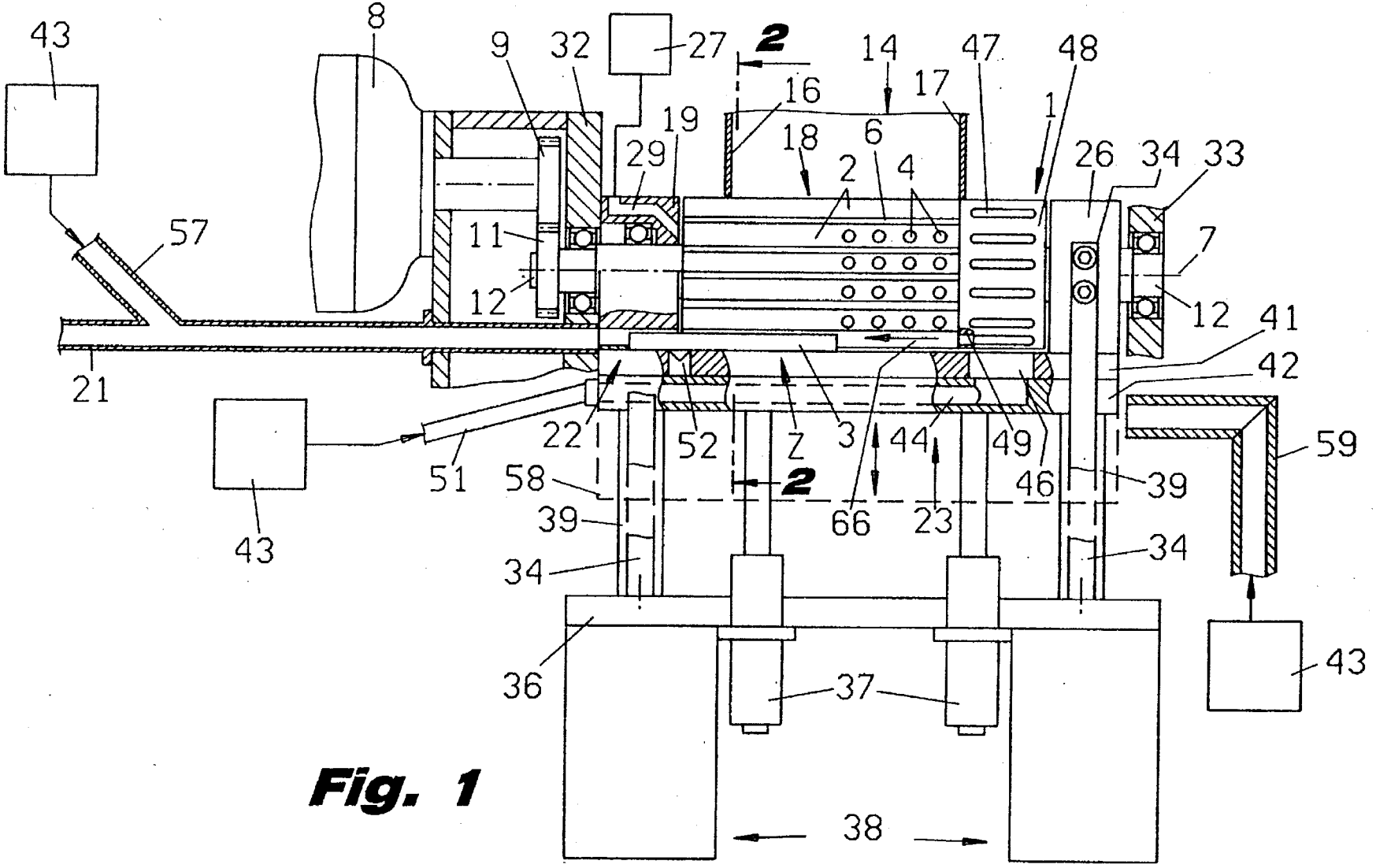
FIG. 1 is a fragmentary partly elevational and partly central vertical sectional view of an apparatus which embodies one form of the invention.
Figure 2:
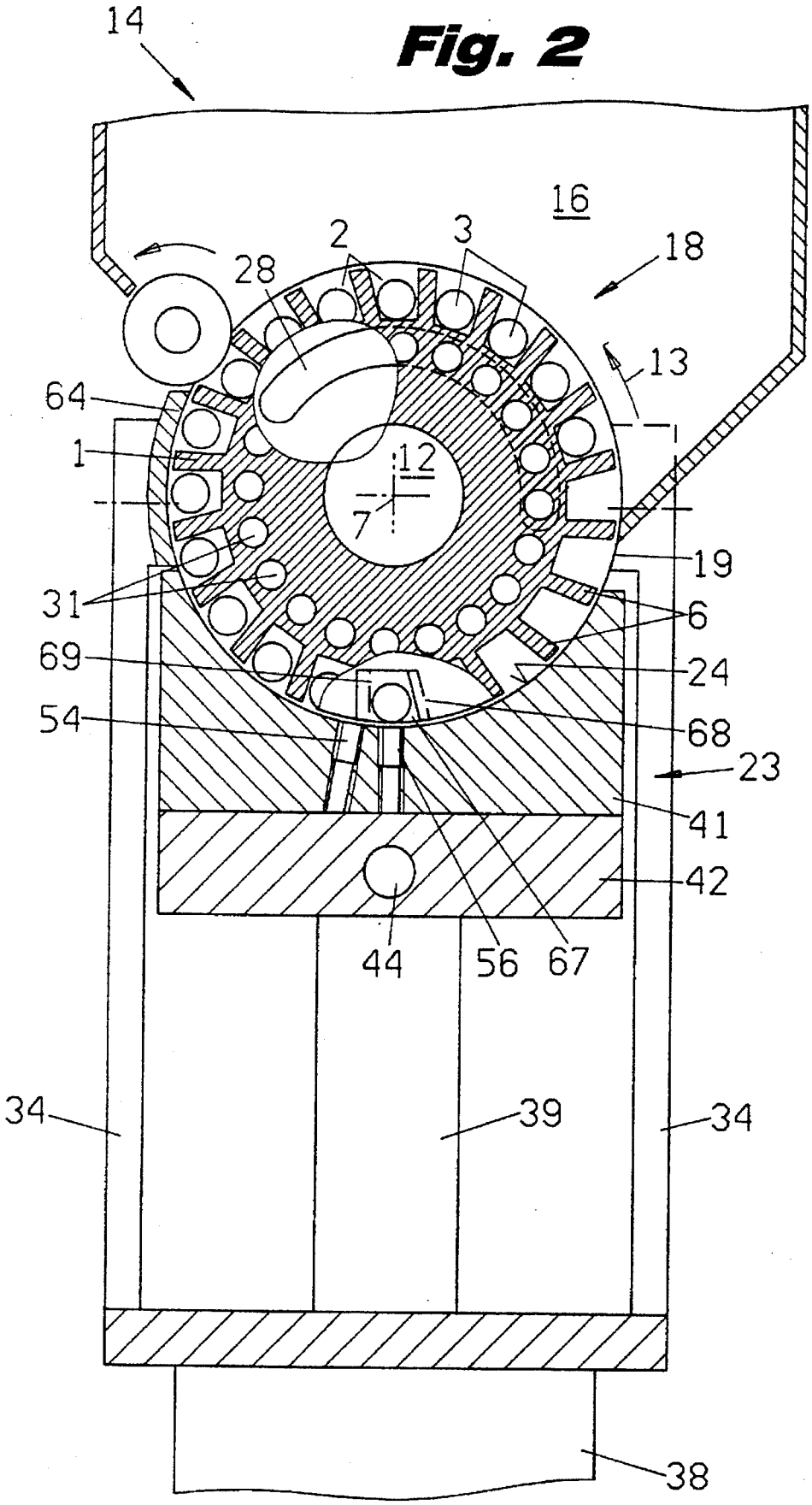
FIG. 2 is an enlarged fragmentary transverse vertical sectional view substantially as seen in the direction of arrows from the line 2—2 of FIG. 1.

FIGS. 1 and 2 illustrate, by way of example, certain relevant details of an apparatus which embodies one form of the present invention and is designed to convert a supply of overlapping parallel elongated rod-shaped articles 3 of the tobacco processing industry (such as filter rod sections of unit length or multiple unit length and hereinafter called articles) from a magazine 14 into a pneumatic conveyor 21. The articles 3 are moved sideways from the magazine 14 to a transfer station Z and thereupon axially into and within the pneumatic conveyor 21.

The means for moving successive articles 3 of a series of such articles from the magazine 14 to the transfer station Z comprises a cylindrical conveyor 1 which is driven by a prime mover 8 (such as a reversible electric motor) to rotate about a horizontal axis 7; such axis is parallel to the axes of the articles 3 in the magazine 14, to the axes of the articles on their way from the magazine 14 to the station Z, as well as at least in the inlet 22 of the pneumatic conveyor 21.

The cylindrical peripheral surface 6 of the conveyor 1 is provided with equidistant axially parallel recesses forming part of elongated receptacles 2 for discrete articles 3. Neighboring receptacles 2 are separated from each other by narrow webs and the bottom portions of the recesses communicate with suction ports 4 connected to a suitable suction generating device 27 to ensure that the articles 3 which enter the receptacles 2 during transport past the pile of parallel articles in the magazine 14 remain in and are properly positioned relative to the respective receptacles during movement toward the transfer station Z. The width of the slots constituting the radially outermost portions of the recesses forming part of the receptacles 2 is sufficient to permit entry of one article 3 at a time (see the upper portion of FIG. 2). The prime mover 8 drives the conveyor 1 in the direction of the arrow 13 and preferably at a constant speed, i.e., the receptacles 2 are in uninterrupted motion during movement past the bottom zone of the magazine 14, thereupon during movement toward the transfer station Z, thereupon during movement past such station, and thereafter during movement back toward the bottom zone of the magazine 14.

The magazine 14 comprises front and rear end walls 16, 17 spaced apart a distance slightly exceeding the length of an article 3 so that the internal space of the magazine can receive and confine a supply or pile of fully or practically fully overlapping articles.

One end portion of each receptacle 2 which arrives at the transfer station Z is caused to move along a relatively narrow section of the arcuate (shown as an endless circular) path for orbital movement of the receptacles 2 about the axis 7 of the conveyor 1. Such end portions of the receptacles 2 are caused to move along the adjacent inlet 22 of the pneumatic conveyor 21. This inlet is installed in a stationary ring-shaped member 19 at the respective axial end of the conveyor 1.

The apparatus further comprises means for sealing successive receptacles 2 at the transfer station Z. The sealing means comprises a relatively large block- or shoe-shaped device 23 which is displaceable up and down between a raised or sealing position of engagement with the adjacent portion of the cylindrical peripheral surface 6 of the conveyor 1 and a second or lowered position in which the radially outermost portion of the receptacle 2 at the transfer station Z is accessible for inspection and/or cleaning, e.g., for expulsion or extraction or gravitational descent of fragments of a damaged or crushed article 3. The sealing device 23 has a concave sealing surface 24 which is complementary to the peripheral surface 6 of the conveyor 1. When the device 23 is caused to assume its raised or sealing position, the concave surface 24 is immediately adjacent but not in actual contact with the peripheral surface 6 because the axial end portions of the surface 24 abut the cylindrical external surface of the aforementioned ring-shaped member 19 and the cylindrical external surface of a second ring-shaped member 26 at the right-hand axial end of the conveyor 1 (as seen in FIG. 1). The axes of the cylindrical (or part cylindrical) external surfaces of the ring-shaped members 19 and 26 coincide with the axis 7 of the conveyor 1 (i.e., with the axis of the cylindrical peripheral surface 6) and with the axis of the concave surface 24 at the upper side of the vertically displaceable sealing device 23. The absence of actual frictional engagement between the surfaces 6 and 24 contributes to longer useful lives of the conveyor 1 and sealing device 23 and renders it possible to establish a predictable sealing action for extended periods of time.

The ring-shaped member 19 constitutes a so-called valve plate which can connect the suction generating device 27 with certain suction ports 4 of the conveyor 1 in each angular position of such conveyor, namely with those suction ports 4 which communicate with receptacles 2 being in the process of receiving articles 3 from the magazine 14 and with receptacles being in the process of moving articles 3 from the magazine 14 toward the transfer station Z. To this end, that side of the member 19 which confronts the conveyor 1 is provided with an arcuate recess 28 (FIG. 2) which is communicatively connected with the suction generating device 27 by one or more bores or holes 29 in the member 19. The conveyor 1 is formed with a circular array of axially parallel bores 31 each of which can draw air from ports 4 in the bottom zone of a discrete receptacle 2. Thus, the device 27 can attract by suction articles 3 to the surfaces bounding the recesses of those receptacles 2 which advance past the arcuate recess 28 in the adjacent side of the stationary ring-shaped member 19.

The prime mover 8 drives a shaft 12 for the conveyor 1 by way of a gearing 9, 11. The shaft 12 is coaxial with the conveyor 1 and is journalled in antifriction bearings provided therefor in two spaced-apart stationary frame members 32, 33 and (if necessary) also in at least one of the ring-shaped members 19, 26. The frame members 32, 33 are outwardly adjacent the members 19, 26, respectively, i.e., the shaft 12 extends through the members 19 and 26 and is nonrotatably coupled with the body of the rotary conveyor 1. The shaft 12 is held against radial wobbling movements relative to the frame members 32, 33. The ring-shaped members 19 and 26 are affixed to a plate-like support 36 by pairs of upright force transmitting members 34 which are installed to pull the shaft 12 and hence the conveyor 1 downwardly; this ensures that the peripheral surface 6 of the conveyor is maintained at an optimum distance from the concave sealing surface 24 of the sealing device 23 when the latter is maintained in the raised or sealing position.

The support 36 further carries upright tracks 37 for the sealing device 23 as well as two fluid-operated motors 38 (e.g., pneumatic motors with reciprocable piston rods 39) which serve to move the device 23 up and down along the tracks 37 between the aforementioned upper or sealing position and the lower or retracted position.

The sealing device 23 of the apparatus which is shown in FIGS. 1 and 2 comprises two parts, namely an upper part 41 which is provided with the aforementioned concave surface 24 and a carrier 42 at the level below the part 41. The carrier 42 can be said to form part of the means for propelling successive articles 3 from their receptacles 2 into the inlet 22 of the pneumatic conveyor 21. To this end, the carrier 42 is provided with a channel 44 which communicates with the outlet of a suitable source 43 of compressed gaseous fluid (such as air) by way of a conduit 51. Compressed air which enters the channel 44 by way of the conduit 51 can flow against the article 3 in the receptacle 2 moving past the transfer station Z by way of a bore 46 in the upper part 41 of the sealing device 23 and slots 47 provided in an axial extension 48 of the rotary conveyor 1. Each slot 47 is aligned with one of the receptacles 2, and the slot 47 at the six o'clock position of the conveyor 1 can receive compressed air from the bore 46 to admit a stream of compressed air into the receptacle 2 moving past the station Z in order to abruptly propel the respective article 3 into the pneumatic conveyor 21. FIG. 1 further shows one of a number of equidistant axially parallel bores 49 which are provided in the body of the rotary conveyor 1 to connect the slots 47 with the recesses of the adjoining aligned receptacles 2.

A monitoring device 52 (e.g., a reflection type photodetector) is installed in the upper part 41 of the sealing device 23 at the boundary between the front end face of the conveyor 1 and the ring-shaped member 19. The purpose of the monitoring device 52 is to transmit to an evaluating circuit 53 (FIG. 5) signals denoting the extent of axial movement of an article 3 during propulsion from the respective receptacle 2 into the inlet 22 of the pneumatic conveyor 21. The illustrated evaluating circuit 53 performs a number of important functions including regulating the operation of the entire apparatus.

The apparatus further comprises means for tracking the positions of successive receptacles 2 during sidewise movement along that section of their arcuate path which is located at the transfer station Z, i.e., which is in line with the inlet 22 of the pneumatic conveyor 21. The tracking means comprises two detectors 54, 56 (FIGS. 2 to 5) which are disposed at the transfer station Z (the same as the monitoring device 52) and are spaced apart from each other in the direction of the arrow 13. Each of the parts 54, 56 can constitute a standard proximity detector, and each of these proximity detectors transmits signals to a discrete input of the evaluating circuit 53, the same as the monitoring device 52.

FIG. 1 further shows a conduit 57 which merges into the pneumatic conveyor 21 downstream of the inlet 22 and can admit into the conveyor 21 a current of compressed air from the source 43 in response to a signal from the evaluating circuit 53 in order to expel an article 3 (or one or more fragments of such article) from the receptacle 2 which is then located at the transfer station Z. The articles 3 (or fragments of such articles) which are expelled from the receptacles 2 at the transfer station Z are caused to move in a direction other than that of advancement of articles from the receptacles 2 into the inlet 22 of the conveyor 21, namely counter to such direction of advancement.

FIG. 1 shows the sealing device 23 in its raised (sealing) position. The axial end portions of the concave surface 24 of the upper part 41 of the device 23 abut the adjacent portions of the external surfaces of the ring-shaped members 19 and 26, i.e., the receptacle 2 advancing past the aforementioned section of the path for the receptacles about the axis 7 of the conveyor 1 is sealed from the atmosphere. The broken line 58 denotes in FIG. 1 the lowered position of the sealing device 31; the receptacle 2 at the station Z is then accessible from below for the purposes of inspection and maintenance (if necessary). A cleaning (impurities evacuating) nozzle 59 has its orifice or orifices trained upon the concave surface 24 when the sealing device 23 is maintained in the lower end position (line 58). The intake of the nozzle 59 can be communicatively connected with the source 43 of compressed air (or with a discrete source) in response to a signal from the evaluating circuit 53.

Figure 5:
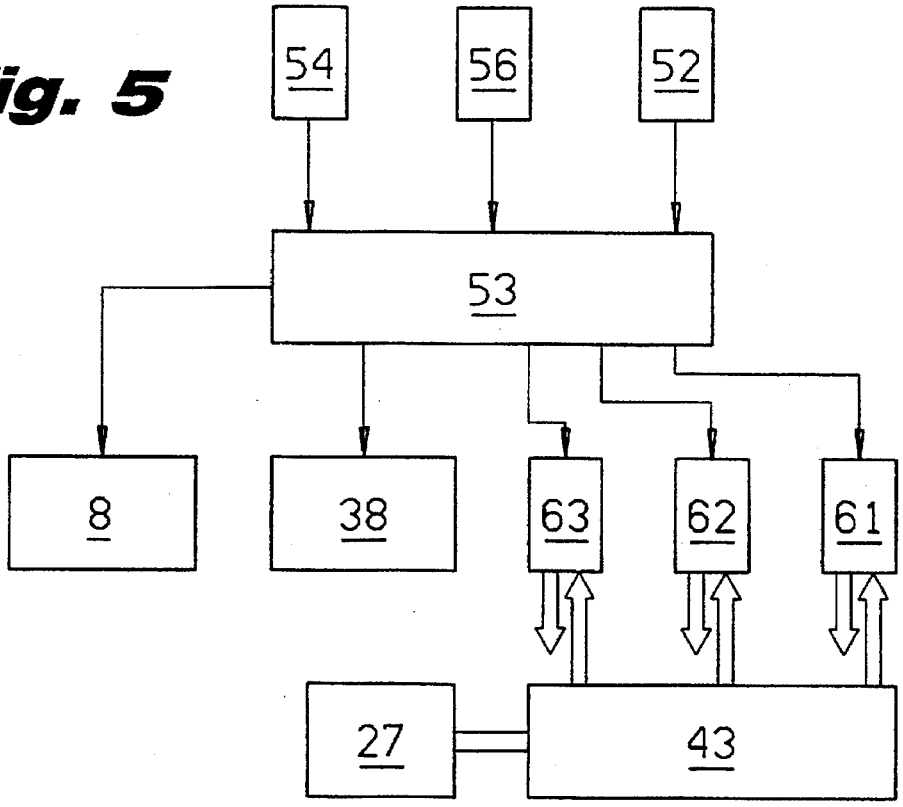
FIG. 5 is a diagrammatic view of the controls in the apparatus of FIGS. 1 to 4.

FIG. 5 shows a first valve 61 which is installed in the conduit 51 and can be actuated by the evaluating circuit 53 to admit compressed air from the source 43 into the channel 44 and bore 46 in order to propel an article 3 from the receptacle moving past the transfer station Z into the inlet of the pneumatic conveyor 21. A second valve 62 (also shown in FIG. 5) can be actuated in response to a signal from the evaluating circuit 53 in order to enable the conduit 57 to admit compressed air from the source 43 into the pneumatic conveyor 21 downstream of the inlet 22 in order to expel an article 3 (or one or more fragments of such article) from the receptacle 2 at the transfer station Z in a direction axially of and away from the inlet 22. A third valve 63 (FIG. 5) can be actuated by the evaluating circuit 53 in order to admit compressed air from the source 43 into the nozzle 59 in the event that the concave surface 24 and/or the peripheral surface 6 of the conveyor 1 necessitates cleaning. In FIG. 5, the electrical conductors are indicated by single lines and the fluid conveying conduits are indicated by parallel lines. The arrows indicate the directions of signal transmission and the directions of fluid flow.

If the apparatus is to be put to use, the motors 38 are actuated to lift the sealing device 23 from the lowered position (broken line 58) to the operative or sealing position which is shown in FIGS. 1 to 4 by solid lines. The concave surface of the upper part 41 of the sealing device 23 then bears against the ring-shaped members 19, 26 and each receptacle 2 which is in the process of moving along the lowermost section of its path (past the inlet 22 of the pneumatic conveyor 21 at the transfer station Z) is then adequately sealed from the surrounding atmosphere to permit predictable propulsion of the respective article 3 into the conveyor 21, namely past the monitoring device 52. The force transmitting members 34 take up the stresses which are being applied to the ring-shaped members 19, 26 in the raised position of the sealing device 23 to thus ensure the establishment of form-locking and/or force-locking connections which are necessary or desirable in actual use of the apparatus. The aforementioned narrow clearance between the peripheral surface 6 of the rotating conveyor 1 and the concave surface 24 of the upper part 41 of the lifted sealing device 23 prevents any frictional engagement between the conveyor 1 and the part 41 and thus contributes to longer useful and disturbance-free life of the apparatus.

The prime mover 8 is controlled by the evaluating circuit 53 to drive the conveyor 1 at a constant speed whereby the receptacles 2 orbit about the common axis 7 of the conveyor 1 and its shaft 12. Successive receptacles 2 receive discrete articles 3 during advancement past the bottom portion 18 of the magazine 14. At such time, the suction ports 4 in the receptacles moving past and beyond the bottom portion 18 are connected to the suction generating device 27 by way of the channel 29 and arcuate recess 28 in the ring-shaped member (valve plate) 19 as well as those axially parallel blind bores 31 in the conveyor 1 which happen to communicate with the recess 28.

When a bore 31 of the rapidly and continuously rotating conveyor 1 advances (in the direction of arrow 13) beyond the downstream end of the recess 28, the respective ports 4 are sealed from the suction generating device 27 and the article 3 in the respective receptacle 2 is immediately acted upon by centrifugal force to move in its receptacle radially outwardly and away from the respective ports 4.

As can be seen in FIG. 2, the blind bores 31 of the conveyor 1 advance beyond the arcuate recess 28 well ahead of the transfer station Z. Therefore, the apparatus further comprises a baffle or shroud 64 having a concave surface confronting the open radially outer ends of the receptacles 2 advancing from the bottom zone 18 of the magazine 14 toward the concave surface 24 of the upper part 41 of the sealing device 23. It will be noted that, in FIGS. 1 and 2, the supplies of axially overlapping parallel articles 3 in the magazine 14 have been omitted for the sake of clarity.

Once the foremost filled receptacle 2 enters that section of its endless path which extends along the inlet 22 of the pneumatic conveyor 21, that end of such receptacle which is remote from the transfer station Z receives a stream of compressed air from the source 43 by way of the conduit 51, bores 44, 46, the corresponding recess 47, and the corresponding bore 49 so that the article is rapidly propelled from its receptacle and advances axially into the pneumatic conveyor 21. The direction of axial propulsion of an article 3 from its receptacle 2 at the station Z into the inlet 22 is indicated in FIG. 1 by an arrow 66. As already mentioned above, an article 3 which is being propelled from its receptacle 2 in the direction of arrow 66 (during movement along that section of the path for the receptacles 2 which extends along the station Z) continues to move sideways. In order to prolong the interval of time during which an article 3 can freely move in the direction of the arrow 66 while simultaneously moving sideways, the width of the inlet 22 is preferably increased in the direction of movement of the receptacles 2 (see FIGS. 2 to 4).

Figure 4:
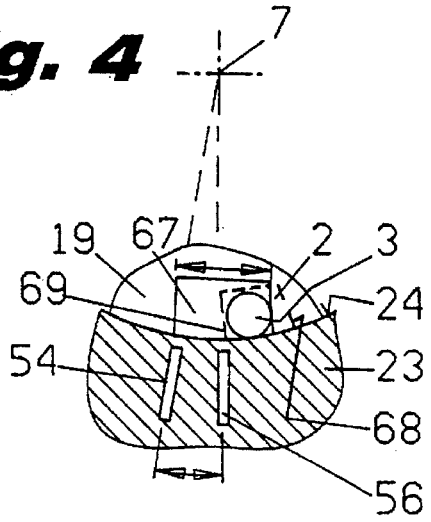
FIG. 4 illustrates the structure of FIG. 3 but with the receptacle in a different position.

The section of FIG. 2 is taken primarily along the line 2—2 in FIG. 1 except at two locations where the conveyor 1 is partly broken away to show the corresponding portions of the ring-shaped member 19. The upper location renders it possible to see a portion of the arcuate recess 28 which draws air from the neighboring blind bores 31 (i.e., from the respective sets of suction ports 4) during movement of the respective receptacles 2 past the bottom zone 18 of the magazine 14. The lower location exposes the inlet 67 of the path which is defined by the pneumatic conveyor 21, i.e., by the inlet 22 which is sealingly mounted in the ring-shaped member (valve plate) 19. A portion of that receptacle 2 which is in the process of moving past the inlet 67 of the path defined by the conveyor 21 is indicated in FIGS. 2 and 4 by broken lines. Such receptacle 2 contains an article 3 which is to be pneumatically propelled into the inlet 22 of the conveyor 21. The character 68 denotes that side of a web between two neighboring receptacles 2 which is adjacent the respective side of the recess in such receptacle, and the character 69 denotes the corresponding side of the web at the other side of the same receptacle. The side 68 is located downstream of the side 69, as seen in the direction of arrow 13.

Figure 3:
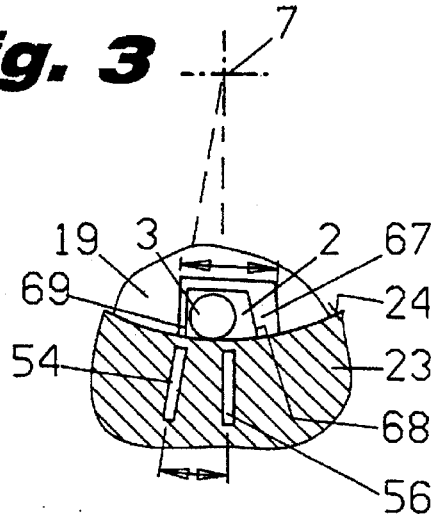
FIG. 3 is a view of a detail in the structure of FIG. 2 and illustrates one receptacle of the rotary conveyor in a first position at the transfer station.

When the apparatus is in use, the step of propelling an article 3 from its receptacle 2 during advancement of the receptacle along that section of its path which extends along the transfer station Z can begin when the discharge end of the receptacle moves to the position (relative to the inlet 67 of the path defined by the pneumatic conveyor 21) which is shown in FIG. 3. At such time, the entire front end face of the article 3 at the station Z is in register with the inlet 67 and the propulsion of the article into the inlet 22 can proceed without any damage to the article. The ability of the article 3 to move axially (arrow 66) without any interference on the part of the inlet 22 ends when the respective receptacle 2 reaches the position of FIG. 4 and a portion of the article 3 supplied by such receptacle is still disposed within the path defined by the receptacle upon completion of movement along the predetermined section (at the station Z) of such path. If a portion of the article 3 is yet to leave its receptacle 2 when the latter reaches the position of FIG. 4, such article is clamped between the rotating conveyor 1 and the stationary inlet 22 of the pneumatic conveyor 21. The magnitude of forces then acting upon the only partially expelled article 3 is sufficient to entail a complete severing of the article. In the event of such severing, a portion of the damaged article advances in the conveyor 21 toward the next station (e.g., into a filter tipping machine wherein the articles 3, assumed to be filter rod sections, are to be united with plain cigarettes, cigars, or cigarillos to form filter cigarettes, cigars, or cigarillos of unit length or multiple unit length). This would result in the making of unsatisfactory filter tipped smokers' products which must be detected and segregated from satisfactory products. In the absence of any remedial undertaking to the contrary, that portion of a severed article 3 which would remain in the respective receptacle 2 would prevent such receptacle from receiving (or at least from properly receiving) a fresh article 3 during renewed movement along the bottom zone 18 of the magazine 14.

In accordance with a feature of the invention, the extent of axial movement of successive articles 3 from their receptacles 2 into the inlet 67 of the path defined by the pneumatic conveyor 21 is monitored by the device 52 and, if the signal from the monitoring device 52 indicates that the transfer of the article 3 was not completed in time, the conveyor 1 is arrested by the evaluating circuit 53 (which controls the prime mover 8) so that the remnant or remnants of a damaged article 3 can be expelled from its receptacle 2 in good time prior to return movement of such receptacle to a position for reception of a fresh article 3 at the bottom zone 18 of the magazine 14.

Figure 6:
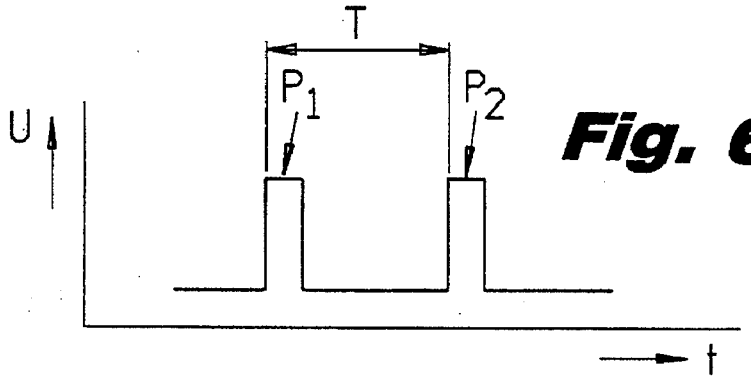
FIGS. 6 through 9 are diagrams showing the relationships of various signals which are generated during different stages of the transfer of rod-shaped articles from the rotary conveyor into the pneumatic conveyor.
Figure 9:
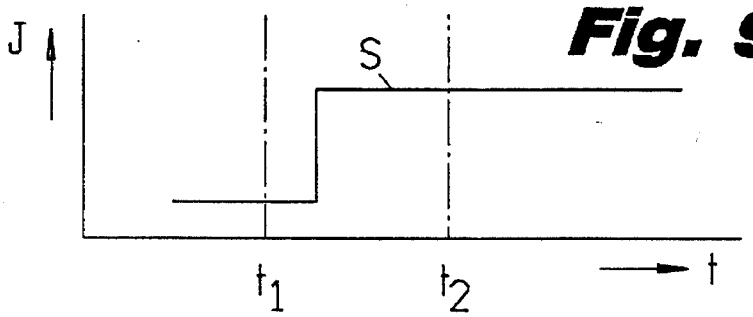

The detectors 54 and 56 at the transfer station Z generate signals $P_1$ and $P_2$ (FIG. 6) denoting the starts and the ends of intervals T during which the discharge end of a receptacle 2 is properly aligned with the inlet 67 for satisfactory propulsion of an article 3 from such receptacle into the pneumatic conveyor 21. The detectors 54 and 56 are positioned to track the movement of the aforementioned upstream side 69 flanking the recess of the receptacle 2 at the station Z. The detector 54 ascertains the arrival of a side 69 at the instant $t_1$ (FIG. 9), and the detector 56 detects the arrival of the same side 69 at the instant $t_2$. The instant $t_1$ is shown in FIG. 3, i.e., the detector 54 has ascertained the arrival of the side 69 and the interval T begins (the corresponding input of the evaluating circuit 53 then receives a signal $P_1$). The signal $P_2$ is transmitted (from the detector 56 to the corresponding input of the evaluating circuit 53) when the side 69 reaches the position of FIG. 4, namely a position in which its presence is detected by the detector 56.

The monitoring device 52 cooperates with the detectors 54, 56 to enable the evaluating circuit 53 to transmit signals which initiate certain remedial actions if the article 3 at the station Z fails to completely leave its receptacle 2 within the respective interval T, i.e., while the discharge end of such receptacle advances between the positions which are shown in FIGS. 3 and 4. The output of the monitoring device 52 transmits to the corresponding input of the evaluating circuit 53 a signal or a series of signals denoting that length of an article 3 which has been propelled past the device 52 (i.e., from the respective receptacle 2) during the interval T. The illustrated monitoring device 52 is set up to transmit a signal S (FIGS. 7, 8, and 9) the duration of which is indicative of the interval that expires during advancement of the article 3 from its receptacle 2 in the direction of the arrow 66 and into the inlet 67 of the path defined by the pneumatic conveyor 21. The signal S is compared in the evaluating circuit 53 with the signal denoting the interval T in order to ascertain whether or not one of these signals completely overlaps (coincides in time with) the other signal.

Figure 7:
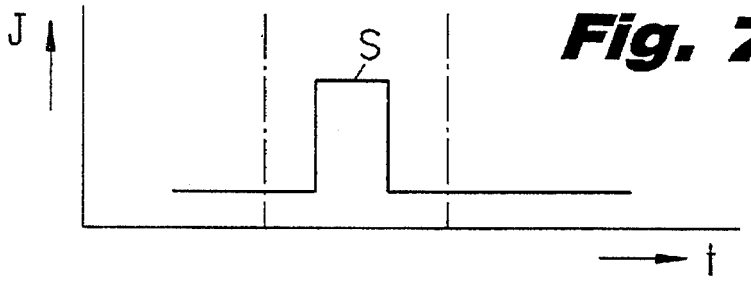

FIG. 7 illustrates an ideal situation when an article 3 completes its advancement from the respective receptacle 2 and all the way into the conveyor 21 within the interval T during which an article is free to advance in the direction of the arrow 66 without any interference on the part of the stationary ring-shaped member 19 and the equally stationary inlet 22 of the pneumatic conveyor 21. The duration of the signal S is less than that of the signal denoting the interval T, and the generation of the signal denoting the interval T respectively begins and ends prior to start and subsequent to completion of the generation of the signal S.

Figure 8:
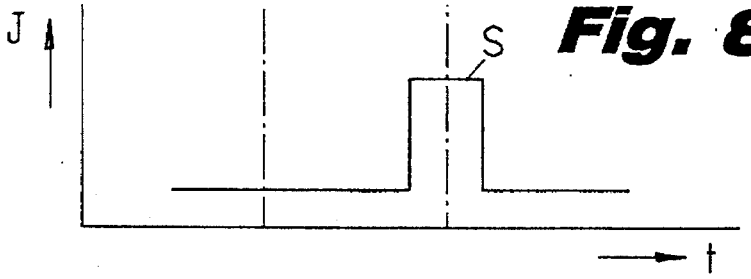

The diagram of FIG. 8 is indicative of a situation when the propulsion of an article 3 from its receptacle 2 during advancement of such receptacle along that section of its path which extends along the transfer station has been initiated too late to ensure that the transfer of such article into the conveyor 21 could be completed in time, i.e., prior to elapse of the interval T. In other words, the interval denoted in FIG. 8 at S partly overlaps with and partly extends beyond the interval T. The evaluating circuit 53 then generates a defect signal which is transmitted to and effects immediate stoppage of the prime mover 8, i.e., the conveyor 1 is brought to an immediate halt. As a rule, the defect signal from the evaluating circuit 53 to the controls of the prime mover 8 is transmitted in time to ensure that the conveyor 1 is arrested before the partially expelled article 3 is sheared off by the conveyor 1 in conjunction with the inlet 22 of the conveyor 21.

The prime mover 8 is preferably a reversible prime mover (e.g., a reversible electric motor of any suitable design), and the defect signal from the evaluating circuit 53 to the prime mover 8 preferably initiates a slight rotary movement of the conveyor 1 counter to the direction which is indicated by the arrow 13. This enables the conveyor 1 and the inlet 22 of the conveyor 21 to release the clamped article 3 so that the latter can be more readily extracted, pneumatically or mechanically expelled, or otherwise removed from the corresponding receptacle 2.

If the freshly unclamped or released article 3 is satisfactory for further use (i.e., if its condition is such that, after having been released by the conveyor 1 and inlet 22 of the conveyor 21, it can continue its axial movement in the direction of the arrow 66), it is simply set in motion again (by the current of compressed air entering the respective receptacle 2 by way of the aligned bore 49) to continue its movement into and within the path defined by the conveyor 21. This can be seen in FIG. 8 which shows that the advancement of an article 3 into the conveyor 21 continues after elapse of the entire interval T. Such mode of counteracting a relatively minor malfunction (which did not result in even partial destruction of the article 3 at the transfer station Z) is desirable and advantageous because the operation of the apparatus must be slowed down or interrupted for a very short period of time.

However, if the damage to (such as mere deformation, deformation and partial destruction, or total destruction) an article 3 which "attempted" to leave its receptacle 2 in good time prior to advancement of the receptacle beyond that section of its arcuate path which extends along the transfer station Z is too pronounced to permit further advancement of the article into the conveyor 21 upon stoppage and short rearward rotation of the conveyor 1 (see FIG. 9), the defect signal from the evaluating circuit 53 is caused to initiate additional corrective undertakings. Such undertakings include actuation of the valves 61 and 62 so that the source 43 of compressed air is sealed from the bore 46 (i.e., the possibility of pneumatically propelling the article from the receptacle 2 at the station Z into the conveyor 21 no longer exists) and the conduit 57 is free to admit compressed air from the source 43 into the conveyor 21 downstream of the inlet 22. The stream of compressed air flowing from the conduit 57 toward and into the inlet 22 then propels the excessively deformed or deformed and otherwise damaged article 3 back into the respective receptacle 2.

The defect signal from the evaluating circuit 53 is further used to actuate the motors 38 which displace the sealing device 23 downwardly and away from the conveyor 1 (note again the broken line 58 in FIG. 1). The defect signal thereupon initiates the actuation of the valve 63 which causes the nozzle 59 to discharge one or more jets of compressed air which relieve the concave surface 24 of fragments (if any) of the deformed and/or otherwise damaged article 3. As a rule, the apparatus cooperates with a suitable collecting receptacle (not shown) which is positioned to automatically intercept any defective articles and/or fragments of articles which were expelled from the receptacles 2 at the transfer station Z and/or from the concave surface 24 of the upper part 41 of the sealing device 23.

The next steps involve preferably automatic resetting of the valves 61, 62, 63, lifting of the sealing device 23 to its raised position, and restarting of the prime mover 8 in a sense to orbit the receptacles 2 in the direction of the arrow 13.

The valve 61 and the conduit 51 exhibit the additional advantage that they greatly reduce the likelihood of penetration of fragments of partially or completely destroyed articles 3 into the machine which is to receive satisfactory articles 3 from the pneumatic conveyor 21.

An advantage of the feature that the monitoring device 52 and/or the detectors 54, 56 are installed in or otherwise carried by the sealing device 23 is that the parts 52, 54, 56 can be positioned relative to the transfer station Z with a very high degree of accuracy which reduces the likelihood of unnecessary damage to articles 3 and/or unnecessary stoppage of the conveyor 1.

The method and apparatus of the present invention exhibit the additional advantage that they render it possible to convert a supply of at least partially overlapping articles 3 into a file of axially aligned articles at a rate greatly exceeding that which can be achieved by resorting to heretofore known methods and apparatus. Moreover, the improved method and apparatus greatly reduce the likelihood of contamination of the machine or machines downstream of the pneumatic conveyor 21 by damaged articles 3 and/or by fragments of damaged articles. Still further, it is possible to expel or otherwise remove damaged articles 3 and/or fragments of damaged articles from the inlet 22 of the pneumatic conveyor 21, from the receptacles 2, from the concave surface 24 of the sealing device 23, and/or from the peripheral surface 6 of the conveyor 1 in a simple and time-saving manner. Moreover, the apparatus can employ a simple and inexpensive control system including the evaluating circuit 53 (or an equivalent of such circuit) and the components which transmit signals to and which receive signals from the circuit 53.

The apparatus of the present invention constitutes and improvement over and a further development of that in comonly owned U.S. Pat. No. 3,827,757 and in commonly owned patent application Ser. No. 08/284,811 (filed Aug. 2, 1994, now U.S. Pat. No. 5,536,118 granted Jul. 19, 1996), both incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A method of converting a supply of at least partially overlapping parallel rod-shaped articles of the tobacco processing industry into a file of axially aligned said articles, comprising the steps of moving a series of successive said rod-shaped articles from the supply along a first path in a first direction substantially at right angles to axes of the articles into and along a predetermined section of said path; advancing said successive articles of said series axially in a second direction from said section of the first path into a second path wherein the advancing articles form the file of axially aligned articles, including propelling each respective said article of said series axially during movement thereof in said first direction along said section of said first path; monitoring an extent of axial advancement of the respective articles along said section during said moving of the respective articles along said section of said first path; and generating defect signals in response to detection of incomplete advancement of said articles of said series into said second path during said moving along said section of said first path.

2. The method of claim 1, wherein said steps of moving and advancing the articles include moving and advancing filter rod sections.

3. The method of claim 1, wherein said signal generating step includes generating one of said defect signals when at least a portion of at least one article of said series is still disposed within said first path upon completion of moving along said section of said first path.

4. The method of claim 1, wherein said first path is an arcuate path and said moving step includes an orbital movement of said articles of said series in said first direction about a fixed axis at least substantially parallel to the axes of said articles in the supply.

5. The method of claim 1, further comprising the step of tracking a length of intervals between entry and departure of receptacles for transport of said articles of said series along said first path into and from said section of said first path.

6. The method of claim 1, wherein said moving step includes transporting the articles in parallel receptacles forming part of a conveyor in which, as a result of said propelling, a first end of each transported article is evacuated from the receptacle ahead of a second end of the respective transported article as seen in said second direction, the method further comprising the step of tracking a first instant of entry of each receptacle into said section and a second instant of departure of each receptacle from said section, said signal generating step including ascertaining a length of intervals between the first and second instants for each receptacle and generating a defect signal when a portion of at least one article of said series remains in the respective receptacle upon expiration of the respective interval.

7. The method of claim 1, further comprising the step of interrupting said moving of said series of successive rod-shaped articles in said first direction in response to the generating of said defect signals.

8. The method of claim 1, wherein said moving step includes transporting the articles in exposable parallel receptacles of a conveyor, the method further comprising the step of exposing selected ones of said parallel receptacles to facilitate removal of said articles of said series therefrom in response to the generating of said defect signals.

9. The method of claim 1, wherein said advancing step further includes the step of propelling the articles with streams of a compressed gaseous fluid, the method further comprising the step of expelling said articles of said series from said section of said first path with compressed gaseous fluid in a direction other than said second direction in response to the generating of said defect signals.

10. Apparatus for converting a supply of at least partially overlapping parallel rod-shaped articles of the tobacco processing industry into a file of axially aligned said rod-shaped articles, said apparatus comprising means for moving a series of successive said rod-shaped articles from the supply along a first path in a first direction substantially at right angles to axes of the articles into and along a predetermined section of said path; means for advancing said successive articles of said series in a second direction along an elongated second path wherein the articles of said series advance axially and form the file of axially aligned articles, said second path having an inlet at said section of said first path and said means for advancing including means for propelling said successive articles of the series from said section of said first path in said second direction and along said second path; means for monitoring an extent of axial movement of said successive articles of said series in said second direction; and means for generating defect signals in response to detected lack of completion of advancement of said articles of said series from said first path within predetermined intervals of time.

11. The apparatus of claim 10, wherein said advancing means further comprises a pneumatic conveyor and said means for propelling comprises means for directing streams of a compressed gaseous fluid against said successive articles of said series in said section of said first path.

12. The apparatus of claim 10, wherein said means for moving includes a rotary conveyor having a plurality of elongated receptacles for discrete said articles of said series and means for driving said rotary conveyor to orbit said receptacles about an axis which is at least substantially parallel to the axes of the articles in the supply.

13. The apparatus of claim 10, wherein said article moving means and said article advancing means define a transfer station which is disposed at said section of said first path, said monitoring means being located at said transfer station.

14. The apparatus of claim 13, wherein said article moving means comprises receptacles for discrete said articles of said series, the apparatus further comprising means for sealing the receptacles at said transfer station.

15. The apparatus of claim 14, wherein said monitoring means is at least partially confined in said sealing means, said sealing means having at least one first sealing surface and said moving means comprising at least one second sealing surface for each of said receptacles, the second sealing surfaces cooperating with said at least one first sealing surface to seal said transfer station and said inlet during movement of the respective receptacles past said transfer station.

16. The apparatus of claim 14, wherein said moving means further comprises a conveyor rotatable about an axis which is parallel to the axes of the articles of the supply, and said conveyor has a peripheral surface provided with recesses parallel to said axes and forming part of said receptacles, said sealing means being adjacent a portion of the peripheral surface of said conveyor and said monitoring means including at least one sensor which is at least partially confined in said sealing means and is disposed at said transfer station.

17. The apparatus of claim 13, wherein said moving means comprises a series of successive receptacles for discrete said articles of said series and means for transporting said receptacles along said first path, the apparatus further comprising means for tracking positions of said successive receptacles during said transporting along said section of said first path and for generating additional signals denoting positions of said receptacles during said transporting past said section of said first path, said means for generating defect signals including means for evaluating said additional signals and for generating third signals denoting lengths of intervals elapsing during said transporting of said successive receptacles along said section of said first path.

18. The apparatus of claim 17, wherein said evaluating means comprises means for ascertaining the presence and absence of full overlap between (a) signals which are generated by said monitoring means and denote the extent of axial displacement of at least one said article of said series and (b) the respective ones of said third signals, and for generating said defect signals in response to ascertained absence of full overlap between the signals generated by said monitoring means and the respective ones of said additional signals generated by said tracking means.

19. The apparatus of claim 18, wherein said tracking means comprises first and second detectors disposed at said station and spaced apart from each other in said first direction to respectively generate first and second signals of said additional signals denoting arrival of one receptacle of said series of successive receptacles at and departure of said one receptacle of said series of successive receptacles from said section of said first path.

20. The apparatus of claim 19, wherein said articles have predetermined diameters, wherein said first detector is located at said station at least substantially in line with an upstream end of said section as seen in said first direction and said second detector is located at said station downstream of and spaced apart from said section by a distance at least approximating one of said diameters.

21. The apparatus of claim 18, wherein said transporting means includes a prime mover operatively connected with said evaluating means to interrupt the transporting of said receptacles in said first direction in response to the generating of each defect signal.

22. The apparatus of claim 18, wherein said transporting means includes a reversible prime mover arranged to transport said receptacles along said first path and being operatively connected with said evaluating means to move said receptacles through a predetermined distance counter to said first direction in response to the generating of said defect signals.

23. The apparatus of claim 18, further comprising a device for sealing the receptacles at said station and means for displacing said device relative to the receptacles at said station between a sealing position and a second position in which that receptacle which is located at said station is accessible, said displacing means being operatively connected with said evaluating means to move said sealing device from said sealing position to said second position in response to the generating of said defect signals.

24. The apparatus of claim 18, further comprising means for expelling contents of the receptacles at said station in response to said defect signals.

25. The apparatus of claim 24, wherein said expelling means includes said propelling means.

26. The apparatus of claim 24, wherein said propelling means comprises a pneumatic conveyor having an inlet at said section of said first path, said expelling means including a source of compressed gaseous fluid and means for communicatively connecting said source with said pneumatic conveyor downstream of said inlet of said pneumatic conveyor, as seen in said second direction, in response to said defect signals to thus admit the compressed gaseous fluid into that receptacle which is located at said station by way of said inlet of said pneumatic conveyor.

27. The apparatus of claim 18, further comprising a device for sealing the receptacles at said station and means for displacing said device relative to the receptacles at said station between a sealing position and a second position in which that receptacle which is located at said station is accessible, said displacing means being operatively connected with said evaluating means to move said sealing device from said sealing position to said second position in response to the generating of said defect signals, and means for cleaning said device in said second position including a source of compressed gaseous fluid and valve-controlled means for directing said compressed fluid from said source against at least one selected portion of said device in response to the generating of said defect signals.

28. The apparatus of claim 27, wherein said at least one selected portion of said sealing device has a surface confronting said moving means, and said means for directing said compressed fluid against said at least one selected portion of said sealing device includes at least one nozzle.

* * * * *